United States Patent [19]

McCune

[11] 4,037,838

[45] July 26, 1977

[54] MINI TENNIS TABLE

[76] Inventor: Walter W. McCune, 200 W. 97th St., Apt. 214, Bloomington, Minn. 55420

[21] Appl. No.: 670,995

[22] Filed: Mar. 26, 1976

[51] Int. Cl.[2] ..... A63B 67/04

[52] U.S. Cl. ..... 273/30; 108/65

[58] Field of Search ..... 273/8, 9, 14, 30; 272/1 R, 1 B; 108/27, 64, 65; 5/100, 184, 185

[56] References Cited

U.S. PATENT DOCUMENTS

| | | | |
|---|---|---|---|
| 713,275 | 11/1902 | Atkins | 273/30 X |
| 1,553,682 | 9/1925 | Froud et al. | 273/30 |
| 2,111,339 | 3/1938 | Squires | 273/30 |
| 2,127,873 | 8/1938 | LeGuillou | 273/30 |
| 2,313,701 | 3/1943 | White | 273/30 |
| 3,298,736 | 1/1967 | Decker | 5/100 X |

*Primary Examiner*—Richard J. Apley

[57] ABSTRACT

A tennis table of a height to enable players seated on chairs to play thereat includes an elongated generally horizontal net extending from the table along opposite side margins thereof for catching a playing ball to prevent it from dropping to the ground. The net includes elongated portions along opposite end margins of the table which are configured to define gaps at the center of the end margins to enable players to be seated adjacent the table.

3 Claims, 2 Drawing Figures

MINI TENNIS TABLE

FIELD OF THE INVENTION

The present invention relates generally to a tennis table. In its particular aspects, it relates to a tennis table having generally horizontal net means extending from opposite sides of the table for catching the playing ball.

BACKGROUND OF THE INVENTION

The game of table tennis or Ping Pong is ordinarily too strenuous for play by the elderly, heart patients or the handicapped. One cause of exertion during the game is that the usual table tennis playing surface is generally elevated to a level which requires that the players stand. Another cause of exertion is that the playing ball will frequently bounce off the table and fall to the ground requiring great effort to retrieve the ball.

OBJECTS OF THE INVENTION

It is an object of the present invention to provide a tennis table of a height which enables players to be seated on chairs.

It is another object of the present invention to provide a tennis table having a net means extending generally horizontally from opposite sides of the table for catching the playing ball and preventing it from dropping to the ground.

SUMMARY OF THE INVENTION

Briefly, the aforementioned and other objects of the present invention are satisfied by providing a tennis table including a rectangular horizontal playing surface which is elevated via plural legs to a height of only about 2 feet to enable players to be seated on chairs at opposite ends of the table during play. For catching the playing ball and preventing it from dropping to the ground, elongated generally horizontal net means is provided extending from the table.

The net means includes first and second portions respectively directed along opposite side margins and opposite end margins of the table. Gaps, generally at the center of the opposed end margins of the table, are provided in the second portions of the net means to enable players to be positioned in the gaps and adjacent the table. According to an alternate embodiment, the second portions of the net means include telescoping portions for adjusting the width of the gaps to accommodate the players therein.

Other objects, features and advantages of the present invention will become apparent upon perusal of the following detailed description of the preferred embodiment thereof when taken in conjunction with the appended drawing wherein:

DETAILED DESCRIPTION

Figures 1, 2:
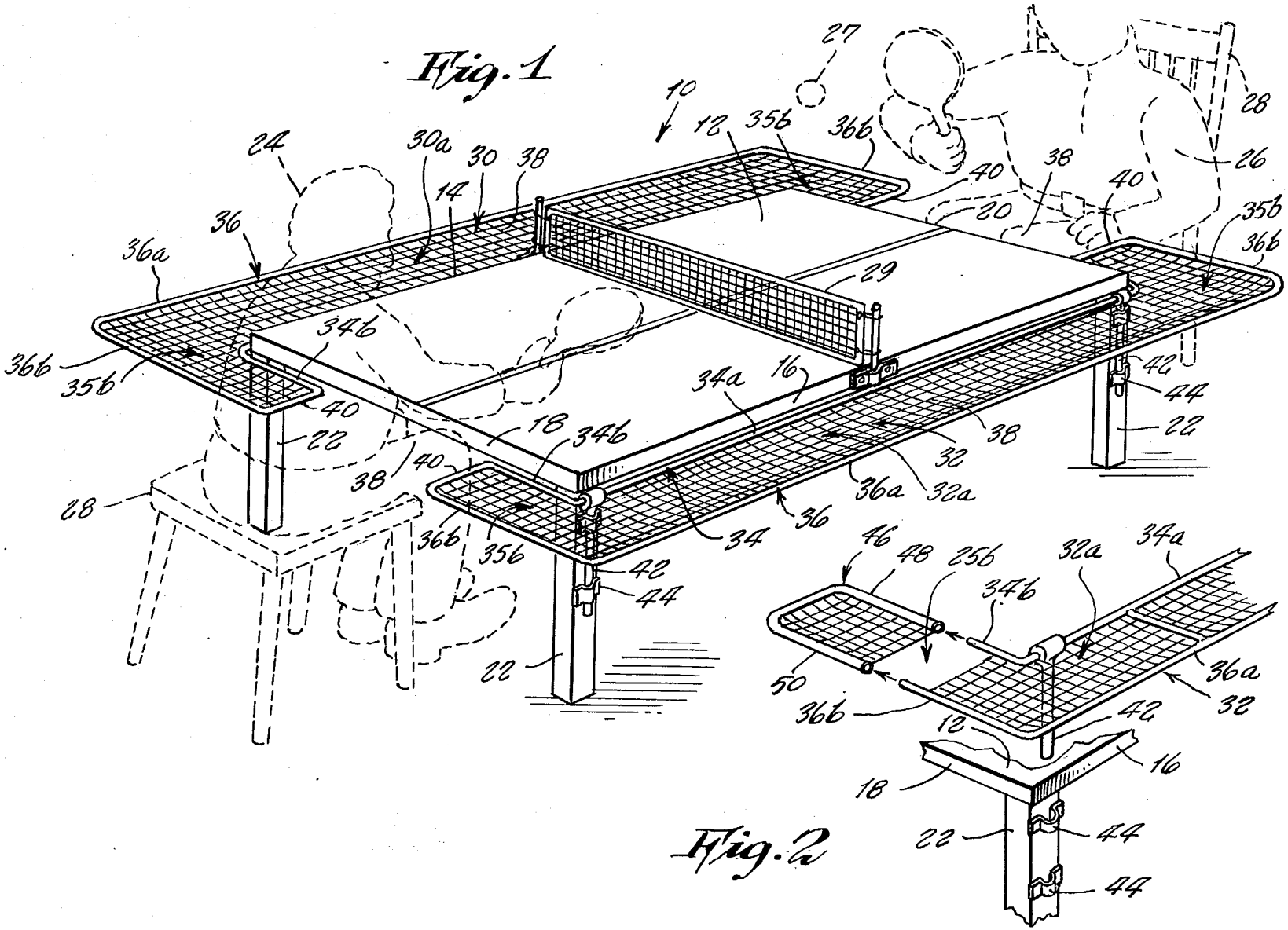
FIG. 1 is a pictorial view of the tennis table of the present invention in conjunction with a pair of seated players shown in phantom.
FIG. 2 is a fragmentary pictorial exploded view of a portion of FIG. 1 but according to an alternate embodiment.

Referring first to FIG. 1 of the drawing, the tennis table of the present invention is generally indicated by the reference numeral 10. Table 10 comprises the usual rectangular flat top or playing surface 12 defined by relatively long opposed side margins 14, 16 and relatively short opposed end margins 18, 20. According to the principles of the present invention, the top is seven feet long and three feet wide. The table legs 22, are relatively short to elevate the playing surface 12 to substantially only two feet above the ground. This height allows opposed players 24, 26 to be seated on chairs 28 at opposite ends of table 12 during play thereby eliminating the strain from standing.

The table 10 includes the usual vertical net 29. As is conventional, the table 10 may be of the folding type which includes the option of allowing one half of the table to project vertically as a backboard so as to enable use by only one player. This is a feature which is easily implemented with reference to U.S. Pat. No. 2,911,217 to J.C. Hirsch et al; issued Nov. 3, 1959.

According to the principles of the present invention, for alleviating the stress which is caused by bending to pick up a playing ball 27 when it has fallen to the ground, opposed generally horizontal net members 30, 32 are respectively provided extending from opposite sides of table 10. Each of net members 30, 32 includes an elongated frame of parallel horizontally spaced tubular rails 34, 36 between which netting 38 is loosely suspended. The rails 34 include first portions 34a respectively directed along the side margins 16 and 18 and second portions directed from the corners of playing surface 12 along the end margins 18, 20. The second portions **34*b* terminates before reaching the center of the end margins 18, 20, to define gaps 38 at which the center of the end margins are exposed to enable the players 24, 26 to be positioned adjacent thereto. The rails 36 are similar to rails 34 including sections 36*a* and 36*b* respectively directed parallel to sections 34*a* and 34*b* but spaced outwardly therefrom. At the point of termination of the rail portions 34*b*, 36*b* they are integrally connected by rail portions 40** directed perpendicularly therebetween.

It will now be appreciated that the net members 30, 32 respectively include first portions **30*a*, 32*a* directed along the respective side margins 14, 16 and each include second portions 35*b* directions part way along the opposite end margins 18, 20.**

The net members 30, 32 are mounted extending from the table 10 via rods 42 which project downward from the rails 34 at the corners thereof and are received in vertically spaced apart guides 44 mounted to the table legs 22. Preferably the guides 44 are located to provide a slight slant of the net members 30, 32 from one end of the table to the other to permit a ball return action. Thus, a ball caught in a net member may roll along the net member to one end of table 10.

Now with reference to FIG. 2 of the drawing, according to an alternate embodiment, the second portions of the net members **35*b* may be telescoping and include at their ends a U-shaped tubular rail 46. In this embodiment, the rail portions 34*b*, 36*b* terminate without the connecting rail 40 of FIG. 1. The opposed legs 48, 50 of the U-shaped rail are then telescopably mounted coaxially about the ends of the respective rail portions 34*b*, 36*b*. Also netting 38 is mounted extending between the legs 48, 50. Consequently, the ends of net portions 35*b* are movable to adjust the width of the gaps 38 to accommodate players 24, 26.**

While the preferred embodiment of the present invention has been described and illustrated in specific detail, it should be understood that numerous modifications additions and omissions in the details thereof are possible within the intended spirit and scope of the invention claimed herein.

What is claimed is:

1. In a tennis table having an elevated, generally rectangular horizontal playing surface defined by opposed relatively long side margins and opposed relatively short end margins, the improvement comprising: an elongated generally horizontal net means extending from said table including first portions directed along said side margins for catching a playing ball and preventing said ball from dropping to the ground; and second elongated portions of said net means directed along said end margins, said second portions defining gaps generally at the center of said end margins for enabling players to be positioned adjacent said end margins.

2. The improvement of claim 1 wherein said second portions include telescoping portions on opposite sides of said gaps for enabling adjustment of the width of said gaps.

3. The improvement of claim 1 further comprising plural legs for supporting said playing surface above the ground, said legs being of a height to position said playing surface substantially 2 feet above the ground for enabling players seated on chairs to play tennis at said table.

* * * * *